US010847916B2

(12) United States Patent
Endo et al.

(10) Patent No.: US 10,847,916 B2
(45) Date of Patent: Nov. 24, 2020

(54) CONNECTOR

(71) Applicant: Yazaki Corporation, Tokyo (JP)

(72) Inventors: Tomomi Endo, Makinohara (JP); Koutarou Tobino, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 16/791,333

(22) Filed: Feb. 14, 2020

(65) Prior Publication Data

US 2020/0295492 A1 Sep. 17, 2020

(30) Foreign Application Priority Data

Mar. 15, 2019 (JP) ..... 2019-048865

(51) Int. Cl.
*H01R 13/424* (2006.01)
*H01R 13/436* (2006.01)

(52) U.S. Cl.
CPC ..... *H01R 13/424* (2013.01); *H01R 13/4361* (2013.01); *H01R 13/4362* (2013.01)

(58) Field of Classification Search
CPC ..... H01R 13/424; H01R 13/4361; H01R 13/4362
See application file for complete search history.

(56) References Cited

U.S. PATENT DOCUMENTS 5,573,432 A * 11/1996 Hatagishi ..... H01R 13/4361 439/459
7,044,808 B1 * 5/2006 Foltz ..... H01R 13/4362 439/752
7,261,603 B2 * 8/2007 Takahashi ..... H01R 13/4361 439/595
7,988,502 B2 8/2011 Nagano et al.
9,666,970 B2 5/2017 Kida
9,859,645 B2 1/2018 Ohfuku et al.
2004/0132351 A1 * 7/2004 Miyakawa ..... H01R 13/4361 439/752
2010/0068911 A1 3/2010 Nagano et al.
2011/0183551 A1 * 7/2011 Hirano ..... H01R 13/4361 439/752
2017/0025780 A1 1/2017 Kida
2017/0069983 A1 3/2017 Ohfuku et al.

FOREIGN PATENT DOCUMENTS

JP 2010-073375 A 4/2010
JP 2015-195124 A 11/2015
JP 2017-054674 A 3/2017

* cited by examiner

*Primary Examiner* — Tho D Ta
(74) *Attorney, Agent, or Firm* — Banner & Witcoff, Ltd.

(57) ABSTRACT

A connector includes a cylindrical connector housing having a retainer and a terminal accommodating chamber in which a terminal is to be inserted. The retainer has first and second flat plate portions, a side plate portion, and a front plate portion. The retainer is attached to the cylindrical connector housing along an attaching direction. A temporary engagement projection and a main engagement projection are provided on a housing outer surface of the cylindrical connector housing so as to be arranged in parallel each other and extend along a direction substantially perpendicular to the attaching direction of the retainer. The temporary engagement projection has a height from the housing outer surface higher than that of the main engagement projection.

3 Claims, 8 Drawing Sheets

CONNECTOR

CROSS REFERENCE TO RELATED APPLICATIONS

This application is based on Japanese Patent Application (No. 2019-048865) filed on Mar. 15, 2019, the contents of which are incorporated herein by reference.

BACKGROUND OF THE INVENTION

1. Field of the Invention

The present invention relates to a connector.

2. Description of the Related Art

There is a connector that retains a terminal in a terminal accommodating chamber of a connector housing by attaching a retainer at a side of the connector housing having the terminal accommodating chamber that accommodates the terminal (see, for example, JP-A-2017-54674, JP-A-2015-195124 and JP-A-2010-73375).

After the retainer is attached to the connector housing, for example, there is a case where the terminal accommodated in the terminal accommodating chamber needs to be replaced due to a failure or the like at a connection location between the terminal and an electric wire. In this case, it is necessary to remove the retainer retaining the terminal in the terminal accommodating chamber from the connector housing.

In order to remove the retainer from the connector housing, it is necessary to insert a jig into a gap between the connector housing and the retainer to release an engagement state of an engagement portion of the retainer with respect to the connector housing. However, the retainer and the connector housing may be damaged by forcibly inserting the jig into the gap between the connector housing and the retainer.

SUMMARY OF THE INVENTION

The invention has been made in view of the above circumstances, and an object of the invention is to provide a connector in which a retainer can be reliably attached to a connector housing, and the attached retainer can be removed without difficulty.

The above-described object of the present disclosure is achieved by below-described structures.

(1) A connector including:

a cylindrical connector housing having a terminal accommodating chamber in which a terminal is to be inserted; and a retainer having:

first and second flat plate portions that face each other;

a side plate portion and a front plate portion that support the first and second flat plate portions, wherein:

the retainer is attached to the cylindrical connector housing along an attaching direction that intersects an insertion direction of the terminal into the terminal accommodating chamber so that the first and second flat plate portions sandwich the cylindrical connector housing from above and below and the retainer retains the terminal accommodated in the terminal accommodating chamber;

a temporary engagement projection and a main engagement projection are provided on a housing outer surface of the cylindrical connector housing so as to be arranged in parallel each other and extend along a direction substantially perpendicular to the attaching direction of the retainer, and the temporary engagement projection has a height from the housing outer surface higher than that of the main engagement projection;

an engagement portion is provided on a side end edge of the first flat plate portion along the insertion direction, and is selectively engaged with the temporary engagement projection or the main engagement projection by sliding the retainer in the attaching direction along the housing outer surface of the cylindrical connector housing; and a releasing jig insertion hole is provided at a tip end portion of the first flat plate portion in the attaching direction, and is configured to receive an insertion of a releasing jig that releases the engagement of the engagement portion with the engagement projection.

(2) For example, the releasing jig insertion portion is provided at a substantially central portion of the side end edge in the insertion direction.

(3) For example, a side wall portion is provided on a side end edge of the housing outer surface along the insertion direction of the terminal so as to cover a tip end edge of the engagement portion in the attaching direction of the retainer.

According to the connector having the above configuration (1), the retainer can be reliably attached to the connector housing by engaging the engagement portion provided on one flat plate portion of the retainer with the main engagement projection provided on the housing outer surface of the connector housing.

In addition, by inserting the releasing jig from the releasing jig insertion portion provided at the tip end portion of the one flat plate portion in the attaching direction of the retainer, engagements of the main engagement projection and the temporary engagement projection with the engagement portion on the flat plate portion are released, so that the retainer can be removed from the connector housing without difficulty. At this time, since the temporary engagement projection has the height from the housing outer surface higher than that of the main engagement projection, the tip end portion of the releasing jig inserted into the releasing jig insertion portion to release the engagement state of the engagement portion with respect to the main engagement projection easily hits the temporary engagement projection. Accordingly, it is possible to prevent damage to the retainer and the connector housing caused by penetration of the tip end portion of the releasing jig that releases the engagement state of the engagement portion with respect to the main engagement projection riding over the temporary engagement projection and inserting deeply.

Further, since front end portions of the retainer formed in a substantially U shape in a cross-sectional view by the pair of flat plate portions and the side plate portion are connected by the front plate portion, a rigidity of the retainer is enhanced by the front plate portion. Accordingly, it is possible to prevent deformation of the retainer when the retainer is removed from the connector housing by the releasing jig.

Therefore, according to the connector of the present configuration, the terminal accommodated in the terminal accommodating chamber can be easily replaced, and a burden on an operator can be reduced.

According to the connector having the above configuration (2), the releasing jig insertion portion is provided at the substantially central portion of the side end edge along the insertion direction of the terminal in the one flat plate portion. Therefore, when the releasing jig is inserted into the releasing jig insertion portion to push up the one flat plate portion, a push-up amount and a push-up force of the engagement portion by the releasing jig can be balanced, the engagement portion can be pushed up in a balanced manner, and the engagements of the engagement portion with the main engagement projection and the temporary engagement projection can be easily released.

According to the connector having the above configuration (3), the tip end edge of the engagement portion of the retainer is covered by the side wall portion formed on the housing outer surface. Therefore, it is possible to prevent the tip end edge of the engagement portion, which is an opening end of the retainer formed in the substantially U shape in the cross-sectional view by the pair of flat plate portions and the side plate portion, from being inadvertently rolled up due to contact with another member or the like.

In addition, since an upper end of the side wall portion serves as a fulcrum of the releasing jig and a lever action is generated when the releasing jig is inserted into the releasing jig insertion portion to push up the flat plate portion, the push-up force of the engagement portion by the releasing jig can be reduced.

According to the invention, it is possible to provide the connector in which the retainer can be reliably attached to the connector housing, and the attached retainer can be removed without difficulty.

The invention has been briefly described above. Further, details of the invention will be further clarified by reading through a mode (hereinafter referred to as "embodiment") for carrying out the invention described below with reference to the accompanying drawings.

BRIEF DESCRIPTION OF THE DRAWINGS

FIG. 8A is a cross-sectional view of the releasing jig before insertion, FIG. 8B is a cross-sectional view when the releasing jig is inserted, and FIG. 8C is a cross-sectional view when an engagement is released by the releasing jig.

FIG. 11A is a cross-sectional view of the releasing jig immediately after insertion, and FIG. 11B is a cross-sectional view when an engagement is released by the releasing jig.

DETAILED DESCRIPTION OF THE EXEMPLARY EMBODIMENTS

Hereinafter, an embodiment of the invention will be described with reference to the drawings.

Figure 1:
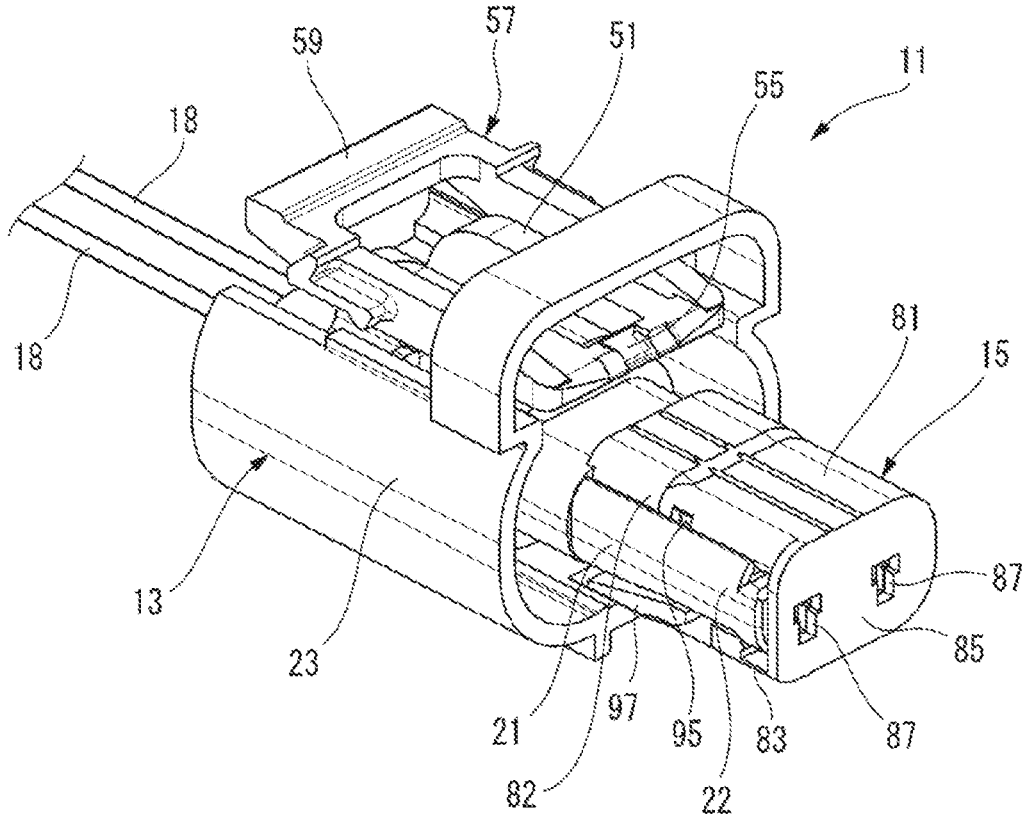
FIG. 1 is a perspective view of a connector according to an embodiment of the invention.
Figure 2:
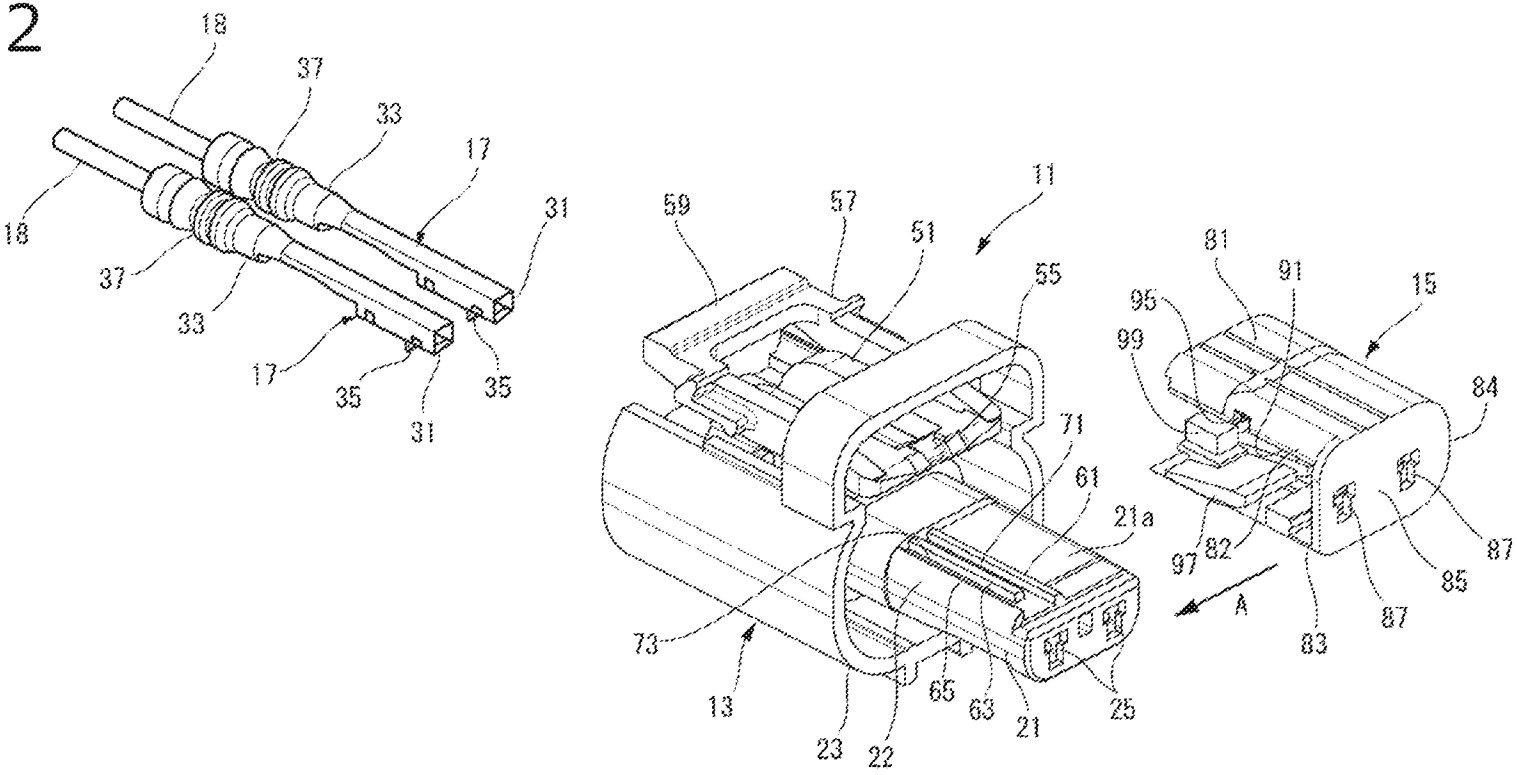
FIG. 2 is an exploded perspective view of the connector shown in FIG. 1.

FIG. 1 is a perspective view of a connector 11 according to an embodiment of the invention. FIG. 2 is an exploded perspective view of the connector 11 shown in FIG. 1.

As shown in FIGS. 1 and 2, the connector 11 includes a female housing 13 and a retainer 15 attached to the female housing 13. A female terminal (terminal) 17 is accommodated in the female housing 13. The connector 11 accommodates a pair of female terminals 17 in the female housing 13.

The female housing 13 is formed by connecting a cylindrical inner housing (connector housing) 21 and a cylindrical outer housing 23 surrounding an outer peripheral surface of the inner housing 21 with a space therebetween. The female housing 13 is made of a synthetic resin, and a hood portion of a male housing (not shown) is inserted into the space between the outer peripheral surface of the inner housing 21 and an inner peripheral surface of the outer housing 23.

The inner housing 21 has two terminal accommodating chambers 25 into which the female terminals 17 are to be inserted into a rear side of the inner housing 21. In each of the terminal accommodating chambers 25, a tip end portion of the inner housing 21 is opened to the outside, and a tab-shaped male terminal (mating terminal) (not shown) provided in the male housing is inserted from a tip end side of the inner housing 21.

The female terminals 17 inserted and accommodated in the terminal accommodating chambers 25 are connected to end portions of electric wires 18. The female terminals 17 include rectangular cylindrical-shaped electrical connecting portions 31 and electric wire connecting portions 33. The electrical connecting portions 31 are electrically connected to male terminals by inserting the male terminals into the electrical connecting portions 31. The electric wire connecting portions 33 are crimped to end portions of electric wires 18 and electrically connected to conductors of the electric wires 18. The electrical connecting portion 31 has an engagement piece portion 35 projecting from a lower portion of the electrical connecting portion 31. In addition, a rubber plug 37 is attached to the electric wire 18, to which the female terminal 17 is connected, at a connection end with the female terminal 17. In each of the terminal accommodating chambers 25, the rubber plug 37 is fitted into the terminal accommodating chamber 25 to seal between the electric wire 18 and the terminal accommodating chamber 25.

The inner housing 21 is formed to project forward relative to a front end surface of the outer housing 23. The retainer 15 is attached to a tip end portion of the inner housing 21 from a side. The inner housing 21 is fitted and connected to the male housing together with the retainer 15.

A housing arm 51 that can be elastically deformed is formed on an outer peripheral surface of the female housing 13. The housing arm 51 is formed in a U shape and is supported in a cantilevered manner on the outer peripheral surface of the female housing 13. The housing arm 51 has an engagement piece 55 that bridges front end portions in a width direction, and the engagement piece 55 is engaged with an engagement projection (not shown) formed on the male housing.

The housing arm 51 is configured such that the engagement piece 55 can swing with a rear end portion as a fulcrum. The housing arm 51 is connected to a U-shaped lock arm 57 supported in the cantilevered manner at a front end portion and extending toward a rear side. The lock arm 57 has an operation portion 59 that is pressed when an engagement state of the housing arm 51 is released.

Figure 3:
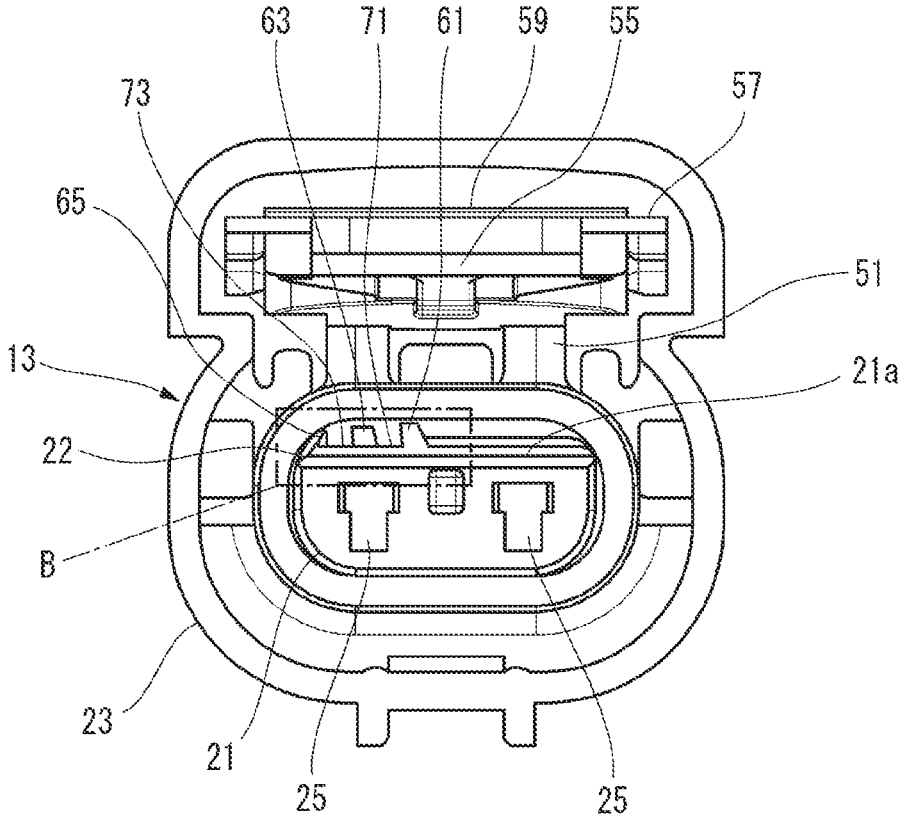
FIG. 3 is a front view of a female housing in the connector shown in FIG. 2.
Figure 4:
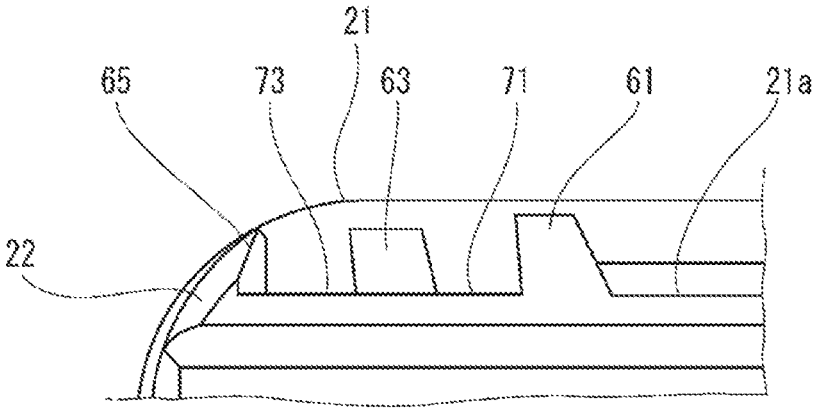
FIG. 4 is an enlarged view of a portion B in FIG. 3.

FIG. 3 is a front view of the female housing 13 in the connector 11 shown in FIG. 2. FIG. 4 is an enlarged view of a portion B in FIG. 3.

As shown in FIG. 3, a temporary engagement projection 61 and a main engagement projection 63 are provided on an upper surface 21*a* which is a housing outer surface of the inner housing (connector housing) 21 to which the retainer 15 is attached from the side. The temporary engagement projection 61 and the main engagement projection 63 are projecting ribs arranged in parallel along an insertion direction of the female terminal 17. The temporary engagement projection 61 and the main engagement projection 63 are sequentially formed and arranged in parallel to each other and arranged along a direction substantially perpendicular to an attaching direction A (see FIG. 2) of the retainer 15. A side wall portion 65 is formed on a side end edge 22 along the insertion direction of the female terminal 17 on the upper surface 21*a* of the inner housing 21 so as to cover a tip end edge 91*a* in the attaching direction A of an engagement portion 91 to be described later. The upper surface 21*a* of the inner housing 21 on which the temporary engagement projection 61, the main engagement projection 63, and the side wall portion 65 are formed has a temporary engagement groove 71 between the temporary engagement projection 61 and the main engagement projection 63 and a main engagement groove 73 between the main engagement projection 63 and the side wall portion 65.

As shown in FIG. 4, a projecting length of the temporary engagement projection 61 is larger than that of the main engagement projection 63. Accordingly, the temporary engagement projection 61 has a height from the upper surface 21*a* of the inner housing 21 higher than that of the main engagement projection 63 from the upper surface 21*a* of the inner housing 21.

Figure 5:
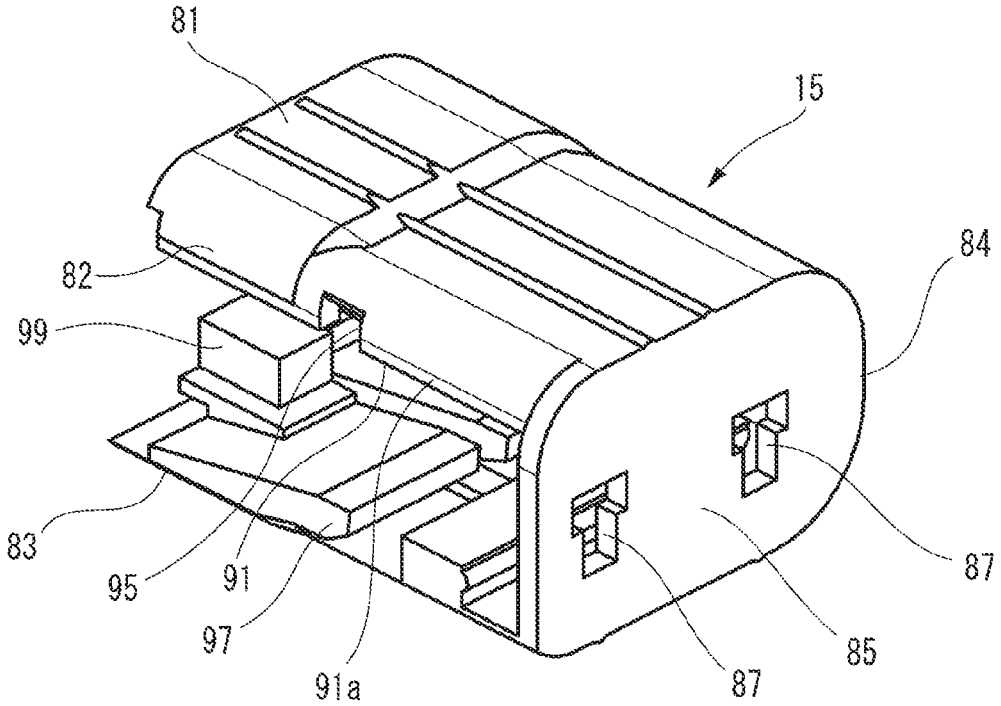
FIG. 5 is a perspective view of a retainer shown in FIG. 2.
Figure 6:
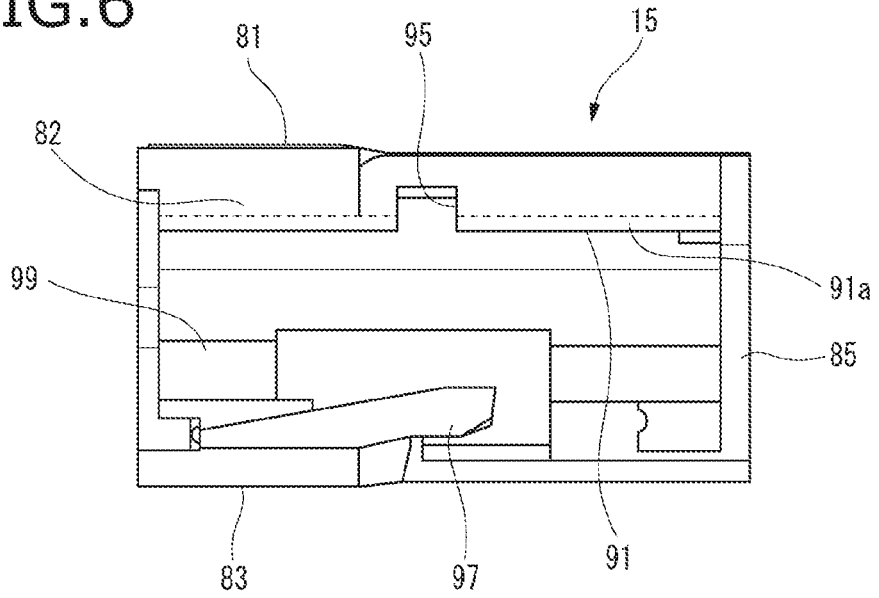
FIG. 6 is a side view of the retainer shown in FIG. 5.

FIG. 5 is a perspective view of the retainer 15 shown in FIG. 2. FIG. 6 is a side view of the retainer 15 shown in FIG. 5.

As shown in FIGS. 5 and 6, the retainer 15 is configured such that a pair of flat plate portions 81 and 83 facing each other are supported with a side plate portion 84 and a front plate portion 85. The retainer 15 is formed of a synthetic resin, and has side end portions of the pair of flat plate portions 81 and 83 which are connected by the side plate portion 84, and are formed in a substantially U shape in a cross-sectional view that open on one side in a width direction that is an attaching side to the inner housing 21, and front end portions are connected by the front plate portion 85. The retainer 15 is attached to the inner housing 21 from the attaching direction A that intersects the insertion direction of the female terminal 17 into the terminal accommodating chamber 25 so that the pair of flat plate portions 81 and 83 sandwich the inner housing 21 from above and below, and retains the female terminal 17 accommodated in the terminal accommodating chamber 25. Two insertion ports 87 are formed in the front plate portion 85 provided at a front end portion of the retainer 15. The insertion ports 87 communicate with the terminal accommodating chambers 25 of the inner housing 21 in a main engagement state in which the retainer 15 attached to the inner housing 21 is disposed at a main engagement position to be described later, and the male terminals are inserted into the insertion ports 87.

Figure 8A:
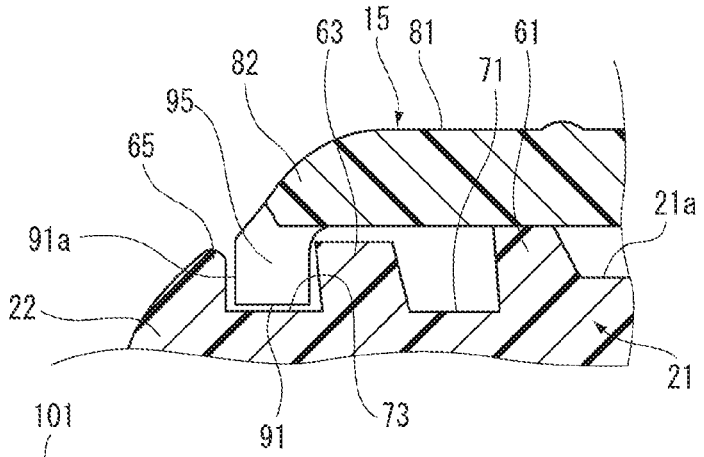
FIGS. 8A to 8C are views showing a location where the retainer is removed by the releasing jig according to the present embodiment.

In the retainer 15, the engagement portion 91 is provided on a side end edge 82 along the insertion direction of the female terminal 17 that is an end edge of an opening side of the upper flat plate portion 81 that is one flat plate portion (see FIG. 8A). The engagement portion 91 projects from the upper flat plate portion 81 toward the lower flat plate portion 83, and is formed in a linear rib shape along a direction orthogonal to the attaching direction A of the retainer 15 to the inner housing 21. By sliding the retainer 15 in the attaching direction A along the upper surface 21*a* of the inner housing 21, the engagement portion 91 formed along a longitudinal direction of the retainer 15 is selectively engaged with the temporary engagement projection 61 or the main engagement projection 63. The engagement portion 91 is disposed in the temporary engagement groove 71 while being engaged with the temporary engagement projection 61, and is disposed in the main engagement groove 73 while being engaged with the main engagement projection 63. The retainer 15 is in a temporarily engagement state in which the engagement portion 91 is engaged with the temporary engagement projection 61 and is disposed in the temporary engagement groove 71, and is in the main engagement state in which the engagement portion 91 is engaged with the main engagement projection 63 and is disposed in the main engagement groove 73.

In addition, the retainer 15 has a releasing jig insertion portion 95. The releasing jig insertion portion 95 is formed for insertion of a releasing jig 101 to be described later, so that a notch is formed in the engagement portion 91. The releasing jig insertion portion 95 is formed at the side end edge 82 of the retainer 15, and is provided at a substantially central portion in the insertion direction of the female terminal 17 into the terminal accommodating chamber 25 in the upper flat plate portion 81.

A lance (flexible engagement piece) 97 and a terminal engagement projection 99 projecting toward an inner side are formed on the lower flat plate portion 83 of the retainer 15. The lance 97 is provided in front of the terminal engagement projection 99 in the insertion direction of the female terminal 17 into the terminal accommodating chamber 25. A tip end of the lance 97 is inclined so as to project toward the upper flat plate portion 81 toward a front side in the insertion direction, and can be elastically deformed.

Next, a case in which the female terminal 17 is accommodated in the female housing 13 will be described.

First, the retainer 15 is attached to the inner housing 21 to be in the temporarily engagement state. Specifically, the retainer 15 is pushed in from the side of the inner housing 21 and moved in the width direction of the inner housing 21 (attaching direction A) so that the inner housing 21 enters a side opening portion of the retainer 15. When the retainer 15 is moved in the attaching direction A, the engagement portion 91 rides over the temporary engagement projection 61 and enters and is engaged with the temporary engagement groove 71. Accordingly, the retainer 15 is brought into the temporarily engagement state with respect to the inner housing 21. When the retainer 15 is brought into the temporarily engagement state with respect to the inner housing 21, the lance 97 of the retainer 15 is disposed in the terminal accommodating chamber 25.

The female terminal 17 to which the electric wire 18 is connected is inserted into the terminal accommodating chamber 25 of the female housing 13 from the rear side. The female terminal 17 is engaged by the engagement piece portion 35 riding over the lance 97, and maintained in an accommodated state in the terminal accommodating chamber 25.

Next, the retainer 15 in the temporarily engagement state is further pushed in, and slides in the attaching direction A. The engagement portion 91 rides over the main engagement projection 63 and enters and is engaged with the main engagement groove 73. Accordingly, the retainer 15 is brought into the main engagement state with respect to the inner housing 21. When the retainer 15 is brought into the main engagement state with respect to the inner housing 21, the terminal engagement projection 99 of the retainer 15 is disposed in the terminal accommodating chamber 25 together with the lance 97. Accordingly, the terminal engagement projection 99 enters a rear end side of the female terminal 17 engaged with the lance 97, and the female terminal 17 is engaged and retained by the lance 97 and the terminal engagement projection 99.

At this time, when the female terminal 17 inserted into the terminal accommodating chamber 25 is in a half-inserted state, the terminal engagement projection 99 of the retainer 15 interferes with the electrical connecting portion 31 of the female terminal 17. That is, when the female terminal 17 is in the half-inserted state, the retainer 15 in the temporarily engagement state cannot be pushed into the main engagement state, so that an operator can recognize that the female terminal 17 is in the half-inserted state.

As described above, the connector 11 according to the present embodiment is capable of detecting the female terminal 17 in the half-inserted state, and has a structure in which the lance 97 and the terminal engagement projection 99 are doubly engaged with the fully inserted female terminal 17.

Here, after the retainer 15 is attached to the inner housing 21, for example, there is a case where the female terminal 17 accommodated in the terminal accommodating chamber 25 needs to be replaced due to a failure or the like at the connection location between the female terminal 17 and the electric wire 18. In this case, it is necessary to remove the retainer 15 in which the female terminal 17 is doubly engaged in the accommodated state in the terminal accommodating chamber 25 from the inner housing 21.

Hereinafter, a case in which the retainer 15 is removed from the inner housing 21 will be described.

Figure 7:
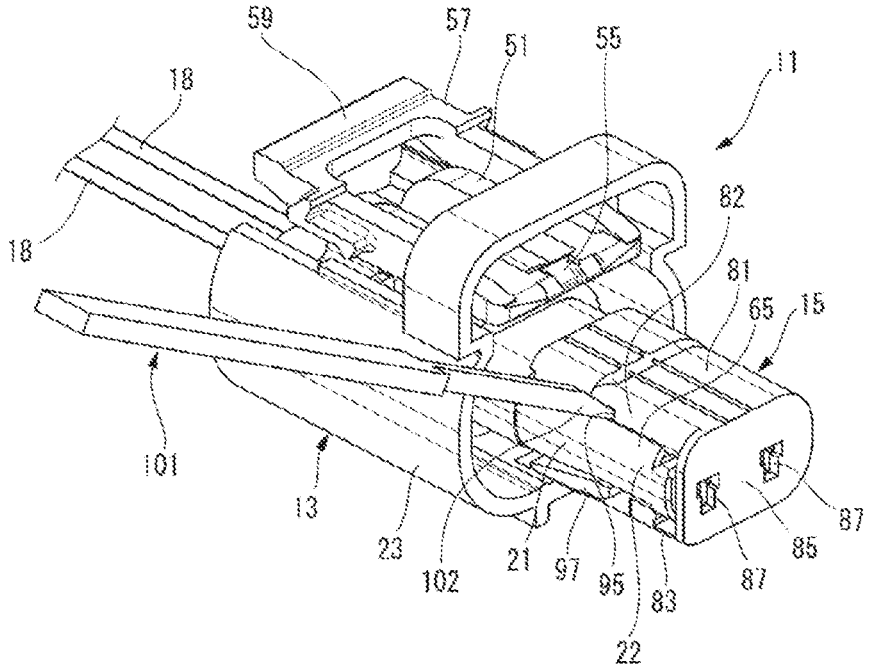
FIG. 7 is a perspective view of the connector according to the present embodiment for showing how to remove the retainer using a releasing jig.
Figure 8B:
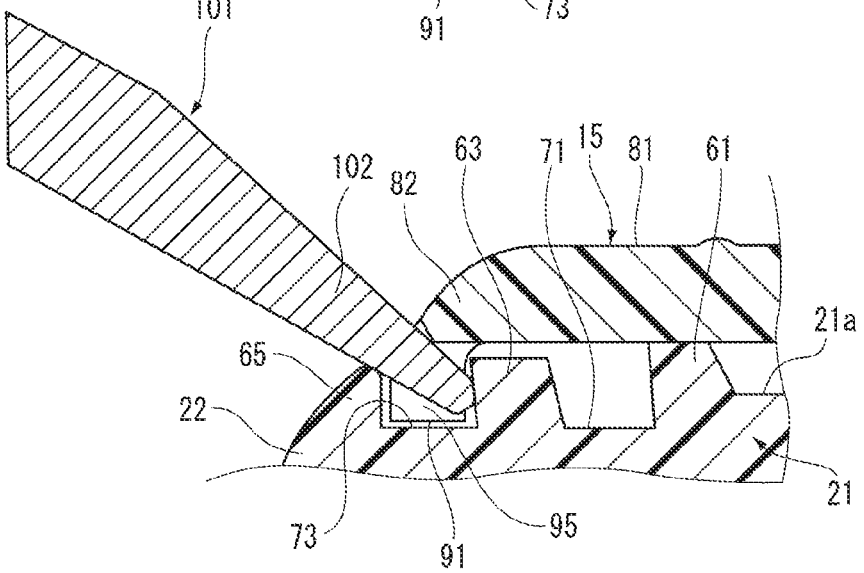
Figure 8C:
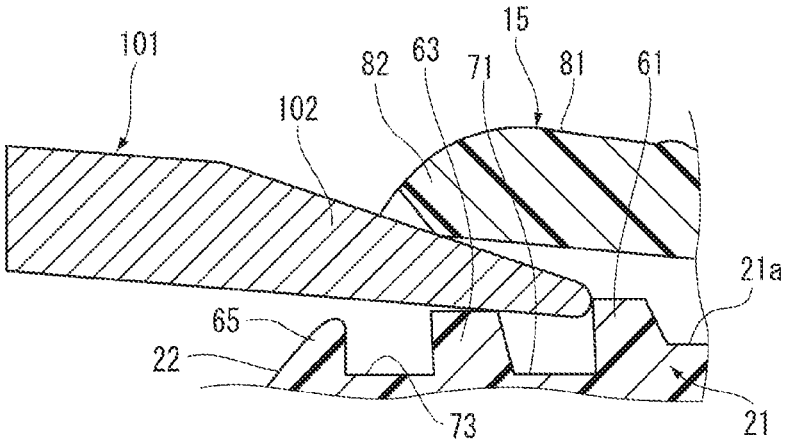

FIG. 7 is a perspective view of the connector 11 according to the present embodiment for showing how to remove the retainer using the releasing jig 101. FIGS. 8A to 8C are views showing a location where the retainer 15 is removed by the releasing jig 101 according to the present embodiment, FIG. 8A is a cross-sectional view of the releasing jig 101 before insertion, FIG. 8B is a cross-sectional view when the releasing jig 101 is inserted, and FIG. 8C is a cross-sectional view when the engagement is released by the releasing jig 101.

As shown in FIG. 8A, in the retainer 15 in the main engagement state with respect to the inner housing 21, the engagement portion 91 is engaged with the main engagement groove 73.

In order to remove the retainer 15 from the inner housing 21, a tip end portion, which is a tip end portion 102 of the rod-shaped releasing jig 101 having a tapered wedge shape, is inserted into the releasing jig insertion portion 95. Then, as shown in FIG. 8B, the tip end portion 102 of the releasing jig 101 enters between the inner housing 21 and the upper flat plate portion 81 of the retainer 15, and inserts into the main engagement groove 73.

In this state, when a rear end side of the releasing jig 101 is pushed down, a tip end portion of the releasing jig 101 inserted into the main engagement groove 73 is lifted up with respect to an upper end of the side wall portion 65 as a fulcrum, and the upper flat plate portion 81 is pushed up by the tip end portion 102 of the releasing jig 101 and is separated from the inner housing 21. Then, the engagement portion 91 formed on the side end edge 82 of the upper flat plate portion 81 is pulled out from the main engagement groove 73, and the engagement state with respect to the main engagement projection 63 is released. Then, when the engagement with the main engagement projection 63 is released, the engagement portion 91 of the retainer 15 rides over the main engagement projection 63 and enters the temporary engagement groove 71.

At this time, as shown in FIG. 8C, the tip end portion of the releasing jig 101 that enters between the upper flat plate portion 81 and the main engagement projection 63 hits the temporary engagement projection 61 whose height from the upper surface 21*a* of the inner housing 21 is higher than that of the main engagement projection 63, and enters the temporary engagement groove 71. Therefore, the upper flat plate portion 81 is not pushed up more than necessary by the releasing jig 101.

The lance 97 of the retainer 15 in the temporarily engagement state is bent toward an outside of the terminal accommodating chamber 25 by the tip end portion of the releasing jig 101, the engagement of the engagement piece portion 35 of the female terminal 17 is released, so that the female terminal 17 can be pulled out from the terminal accommodating chamber 25.

Further, when removing the retainer 15 from the inner housing 21, the rear end side of the releasing jig 101 whose tip end portion is inserted into the temporary engagement groove 71 from the releasing jig insertion portion 95 is pushed down. Therefore, the tip end portion of the releasing jig 101 is lifted up with respect to the upper end of the main engagement projection 63 as the fulcrum, and the flat plate portion 81 is pushed up by the tip end portion of the releasing jig 101 and is separated from the inner housing 21. Then, the engagement portion 91 formed on the side end edge 82 of the upper flat plate portion 81 is pulled out from the temporary engagement groove 71, and the engagement state with respect to the temporary engagement projection 61 is released. By moving the retainer 15 in a direction reverse to that at the time of attaching the retainer 15 to the inner housing 21, the engagement portion 91 rides over the temporary engagement projection 61, and the retainer 15 is removed from the inner housing 21.

As described above, according to the connector 11 of the present embodiment, the retainer 15 can be reliably attached to the inner housing 21 by engaging the engagement portion 91 provided on the upper flat plate portion 81 of the retainer 15 with the main engagement projection 63 provided on the upper surface 21*a* of the inner housing 21.

In addition, by inserting the releasing jig 101 from the releasing jig insertion portion 95 provided at a tip end portion of the upper flat plate portion 81 in the attaching direction of the retainer 15, the engagements of the main engagement projection 63 or the temporary engagement projection 61 with the engagement portion 91 on the flat plate portion 81 are released, so that the retainer 15 can be removed from the inner housing 21 without difficulty.

Here, a connector according to a reference example will be described.

The same components as those of the connector 11 of the above embodiment are denoted by the same reference numerals, and a detailed description thereof is omitted.

Figure 9:
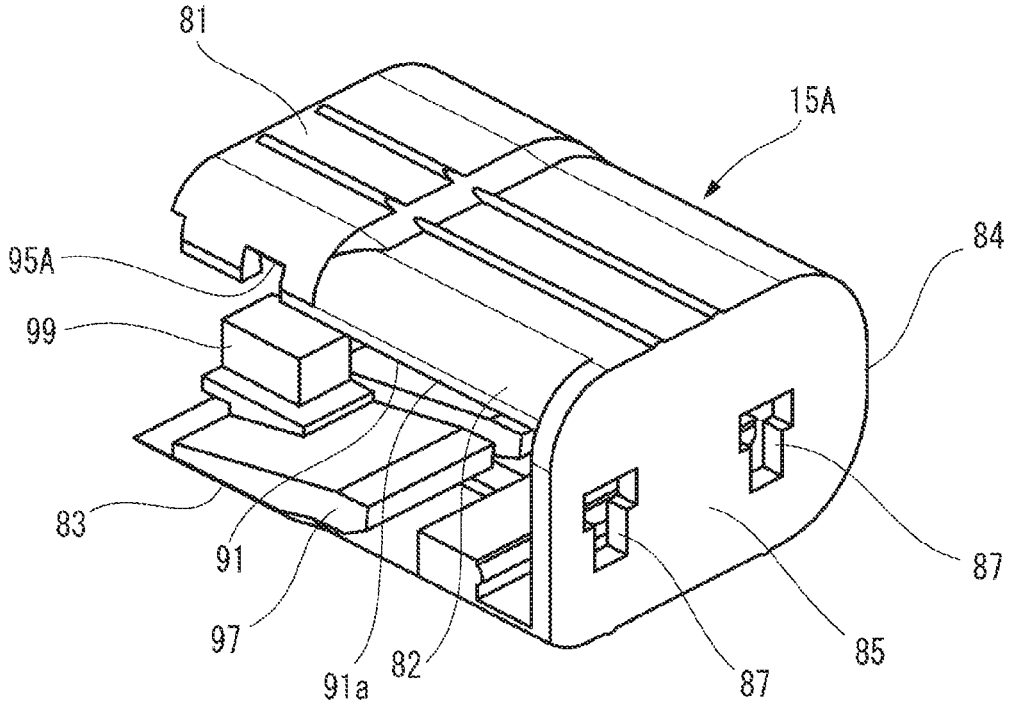
FIG. 9 is a perspective view of a retainer constituting a connector according to a reference example.
Figure 10:
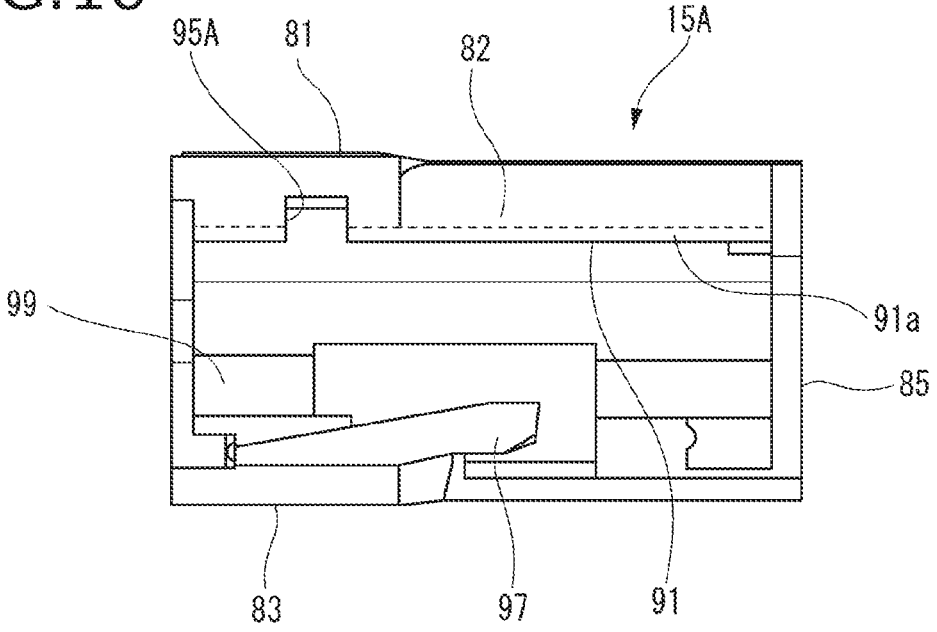
FIG. 10 is a side view of the retainer shown in FIG. 9.
Figure 11A:
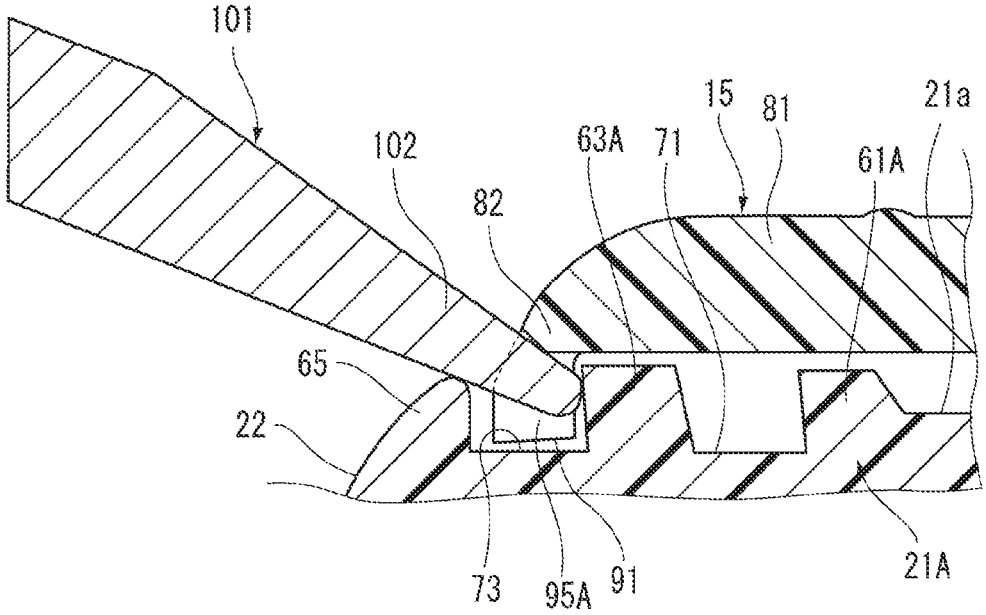
FIGS. 11A and 11B are views showing a location where the retainer is removed by the releasing jig according to the reference example.
Figure 11B:
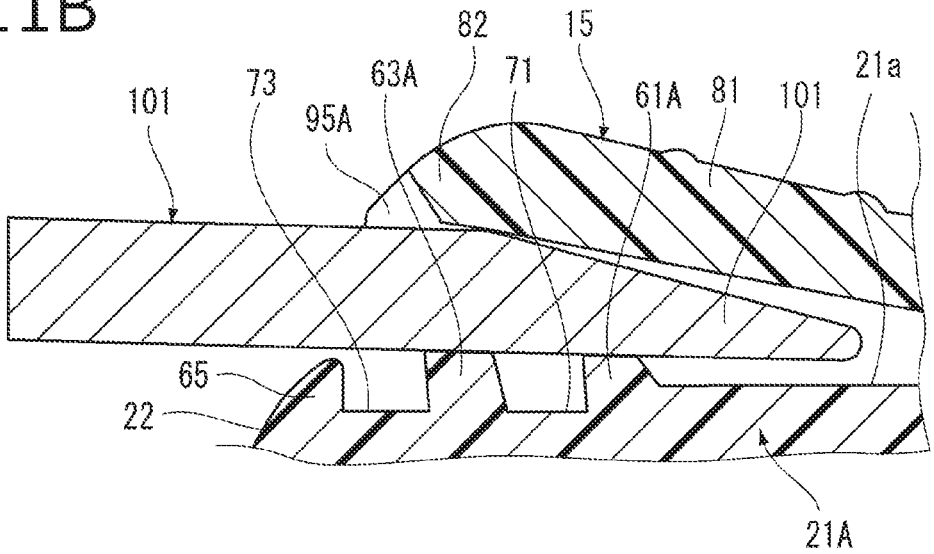

FIG. 9 is a perspective view of a retainer 15A constituting the connector according to the reference example. FIG. 10 is a side view of the retainer 15A shown in FIG. 9. FIGS. 11A and 11B are views showing a location where the retainer 15A is removed by the releasing jig 101 according to the reference example, FIG. 11A is a cross-sectional view of the releasing jig 101 immediately after insertion, and FIG. 11B is a cross-sectional view when the engagement is released by the releasing jig 101.

As shown in FIGS. 9 and 10, in the retainer 15A of the connector according to the reference example, a releasing jig insertion portion 95A is provided at a rear side in the insertion direction of the female terminal 17 into the terminal accommodating chamber 25 in the upper flat plate portion 81. In addition, as shown in FIG. 11A, according to the reference example, a temporary engagement projection 61A and a main engagement projection 63A formed in an inner housing 21A have substantially a same height from the upper surface 21*a* of the inner housing 21A.

In the connector according to the reference example, the releasing jig insertion portion 95A is provided at a position closer to a rear side of the side end edge 82 along the insertion direction of the female terminal 17 in the upper flat plate portion 81. Therefore, the upper flat plate portion 81 cannot be pushed up in a balanced manner by the releasing jig 101 inserted into the releasing jig insertion portion 95A. That is, in order to release the engagement by the engagement portion 91 at the front side in the insertion direction of the female terminal 17 away from the releasing jig insertion portion 95A, the upper flat plate portion 81 needs to be greatly pushed up by the releasing jig insertion portion 95A, and the upper flat plate portion 81 may be damaged.

In the connector according to the reference example, the temporary engagement projection 61A and the main engagement projection 63A have substantially the same height from the upper surface 21*a* of the inner housing 21A. Therefore, as shown in FIG. 11A, the tip end portion of the releasing jig 101 inserted into the releasing jig insertion portion 95A to release the engagement state of the engagement portion 91 with respect to the main engagement projection 63A may ride over the temporary engagement projection 61A and be inserted deeply, thereby damaging the retainer 15A and the inner housing 21A. In particular, when the releasing jig 101 is inserted deeply after riding over the temporary engagement projection 61A, the upper flat plate portion 81 may be greatly pushed up and damaged.

On the other hand, according to the connector 11 according to the present embodiment, since the temporary engagement projection 61 has the height from the upper surface 21*a* of the inner housing 21 higher than that of the main engagement projection 63, the tip end portion of the releasing jig 101 inserted into the releasing jig insertion portion 95 to release the engagement state of the engagement portion 91 with respect to the main engagement projection 63 easily hits the temporary engagement projection 61. Accordingly, it is possible to prevent the damage to the retainer 15 and the inner housing 21 caused by penetration of the tip end portion of the releasing jig 101 that releases the engagement state of the engagement portion 91 with respect to the main engagement projection 63 riding over the temporary engagement projection 61 and inserting deeply.

Further, since the front end portions of the retainer 15 formed in a substantially U shape in a cross-sectional view by the pair of flat plate portions 81 and 83 and the side plate portion 84 are connected by the front plate portion 85, a rigidity of the retainer 15 is enhanced by the front plate portion 85. Accordingly, it is possible to prevent deformation of the retainer 15 when the retainer 15 is removed from the inner housing 21 by the releasing jig 101.

According to the connector 11 of the present embodiment, the releasing jig insertion portion 95 is provided at the substantially central portion of the side end edge 82 along the insertion direction of the female terminal 17 in the upper flat plate portion 81. Therefore, when the releasing jig 101 is inserted into the releasing jig insertion portion 95 to push up the upper flat plate portion 81, a push-up amount and a push-up force of the engagement portion 91 by the releasing jig 101 can be balanced, the engagement portion 91 can be pushed up in a balanced manner, and the engagement of the engagement portion 91 with the main engagement projection 63 and the temporary engagement projection 61 can be easily released.

Further, according to the connector 11 of the present embodiment, the tip end edge 91*a* of the engagement portion 91 of the retainer 15 is covered with the side wall portion 65 formed on the side end edge 22 along the insertion direction of the female terminal 17 on the upper surface 21*a* of the inner housing 21. Therefore, it is possible to prevent the tip end edge 91*a* of the engagement portion 91, which is an opening end of the retainer 15 formed in the substantially U shape in the cross-sectional view by the pair of flat plate portions 81 and 83 and the side plate portion 84, from being inadvertently rolled up due to contact with another member or the like.

In addition, since the upper end of the side wall portion 65 serves as the fulcrum of the releasing jig 101 and a lever action is generated when the releasing jig 101 is inserted into the releasing jig insertion portion 95 to push up the upper flat plate portion 81, the push-up force of the engagement portion 91 by the releasing jig 101 can be reduced.

Therefore, according to the connector 11 of the present embodiment, the female terminal 17 accommodated in the terminal accommodating chamber 25 can be easily replaced, and a burden on the operator can be reduced.

The invention is not limited to the embodiment described above, and modifications, improvements, and the like can be made as appropriate. In addition, material, shape, dimension, numerical value, form, number, arrangement locations, etc. of each constituent element in the above-described embodiment are optional as far as the invention can be achieved, and are not limited.

The characteristics of the embodiment of the connector according to the invention will be briefly summarized in the following [1] to [3].

[1] A connector (11) including:

a cylindrical connector housing (inner housing 21) having a terminal accommodating chamber (25) in which a terminal (female terminal 17) is to be inserted; and a retainer (15) having:

first and second flat plate portions (81, 83) facing each other;

a side plate portion 84 and a front plate portion 85 that support the first and second flat plate portions, wherein the retainer is attached to the cylindrical connector housing (inner housing 21) along an attaching direction (A) that intersects an insertion direction of the terminal into the terminal accommodating chamber so that the first and second flat plate portions (81, 83) sandwich the cylindrical connector housing (inner housing 21) from above and below and the retainer retains the terminal (female terminal 17) accommodated in the terminal accommodating chamber (25);

a temporary engagement projection (61) and a main engagement projection (63) arranged are provided on a housing outer surface (upper surface 21*a*) of the cylindrical connector housing (inner housing 21) so as to be arranged in parallel each other and extend along a direction substantially perpendicular to the attaching direction (A) of the retainer (15), and the temporary engagement projection (61) has a height from the housing outer surface (upper surface 21*a*) higher than that of the main engagement projection (63), an engagement portion (91) is provided on a side end edge (82) of the first flat plate portion (81) along the insertion direction of the terminal (female terminal 17), and is selectively engaged with the temporary engagement projection (61) or the main engagement projection (63) by sliding the retainer (15) in the attaching direction (A) along the housing outer surface (upper surface 21*a*), and a releasing jig insertion portion (95) for insertion of a releasing jig (101) that releases the engagement of the engagement portion (91) with the main engagement projection (63) is provided at a tip end portion of the one upper flat plate portion (81) in the attaching direction.

[2] The connector (11) according to the above [1], in which the releasing jig insertion portion (95) is provided at a substantially central portion of the side end edge (82) in the insertion direction.

[3] The connector (11) according to the above [1] or [2], in which a side wall portion (65) is provided on a side end edge (22) of the housing outer surface (upper surface 21*a*) along the insertion direction of the terminal (female terminal 17) so as to cover a tip end edge (91*a*) of the engagement portion (91) in the attaching direction (A) of the retainer (15).

What is claimed is:

1. A connector comprising:

a cylindrical connector housing having a terminal accommodating chamber in which a terminal is to be inserted; and a retainer having:

first and second flat plate portions that face each other;

a side plate portion and a front plate portion that support the first and second flat plate portions, wherein:

the retainer is attached to the cylindrical connector housing along an attaching direction that intersects an insertion direction of the terminal into the terminal accommodating chamber so that the first and second flat plate portions sandwich the cylindrical connector housing from above and below and the retainer retains the terminal accommodated in the terminal accommodating chamber;

a temporary engagement projection and a main engagement projection are provided on a housing outer surface of the cylindrical connector housing so as to be arranged in parallel each other and extend along a direction substantially perpendicular to the attaching direction of the retainer, and the temporary engagement projection has a height from the housing outer surface higher than that of the main engagement projection; an engagement portion is provided on a side end edge of the first flat plate portion along the insertion direction, and is selectively engaged with the temporary engagement projection or the main engagement projection by sliding the retainer in the attaching direction along the housing outer surface of the cylindrical connector housing; and a releasing jig insertion hole is provided at a tip end portion of the first flat plate portion in the attaching direction, and is configured to receive an insertion of a releasing jig that releases the engagement of the engagement portion with the main engagement projection.

2. The connector according to claim 1, wherein:

the releasing jig insertion hole is provided at a substantially central portion of the side end edge in the insertion direction.

3. The connector according to claim 1, wherein:

a side wall portion is provided on a side end edge of the housing outer surface along the insertion direction of the terminal so as to cover a tip end edge of the engagement portion in the attaching direction of the retainer.

* * * * *